US005095701A

United States Patent [19]

Nakano

[11] Patent Number: 5,095,701

[45] Date of Patent: Mar. 17, 1992

[54] APPARATUS FOR CONTROLLING ROTATIONAL SPEED OF STIRLING ENGINE

[75] Inventor: Yoshinobu Nakano, Toyota, Japan

[73] Assignee: Aisin Seiki Kabushiki Kaisha, Kariya, Japan

[21] Appl. No.: 674,902

[22] Filed: Mar. 26, 1991

[30] Foreign Application Priority Data

Mar. 31, 1990 [JP] Japan ..... 2-85885

[51] Int. Cl.[5] ..... F02G 1/05

[52] U.S. Cl. ..... 60/521; 290/51; 290/1 R

[58] Field of Search ..... 60/521, 522; 290/1 R, 290/40 R, 51

[56] References Cited

U.S. PATENT DOCUMENTS 4,457,133 7/1984 Almstrom et al. ..... 60/521 X 4,881,372 11/1989 Naito ..... 60/521

*Primary Examiner*—Allen M. Ostrager

*Attorney, Agent, or Firm*—Burns, Doane, Swecker & Mathis

[57] ABSTRACT

There is disclosed an apparatus for controlling the rotational speed of a Stirling engine in such a way that effective use is made of dump power produced when the speed of the engine is maintained constant. The apparatus comprises a tank in which a working medium is stored, a first valve mechanism, a second valve mechanism, a dynamo for producing alternating current during operation of the engine, a load to which the alternating current is applied, an accessary receiving the alternating current via a distributor, and a control unit. When a change in the electric power consumed by the load is detected, the control unit actuates the first or second valve mechanism to force the working medium out of the tank into the working space in the engine or vice versa such that the speed of the engine corresponds to the change in the electric power. When the engine speed increases, the resulting increase in the electric power is consumed for the accessary such as a cooling fan or a battery that powers the starter.

4 Claims, 1 Drawing Sheet

Figure
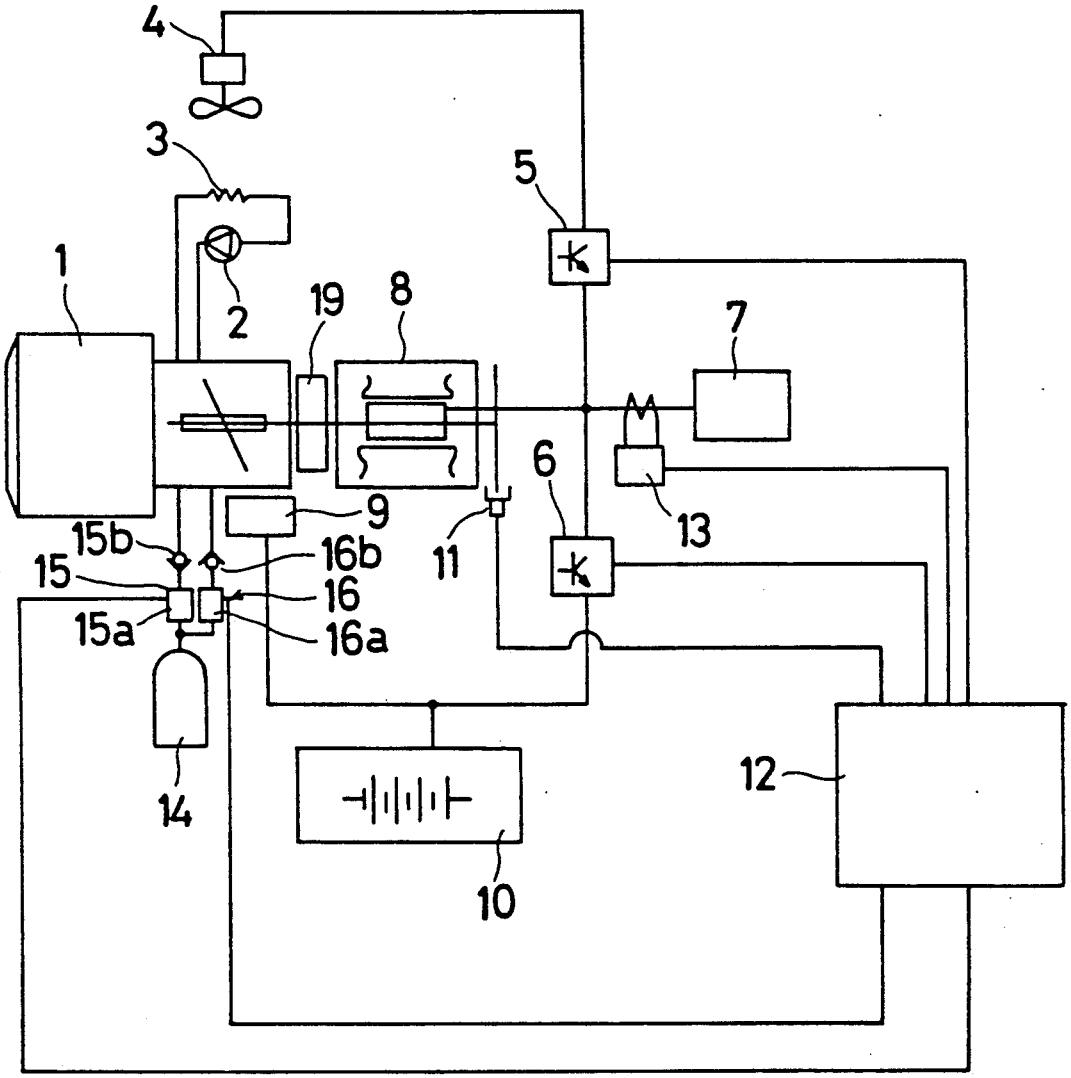

APPARATUS FOR CONTROLLING ROTATIONAL SPEED OF STIRLING ENGINE

FIELD OF THE INVENTION

The present invention relates to an apparatus for controlling the rotation speed of a Stirling engine.

BACKGROUND OF THE INVENTION

Japanese Patent Laid-Open No. 235649/1988, issued Sept. 30, 1988, discloses an apparatus which controls the rotational speed of a Stirling engine. In this apparatus, the dynamo driven by the Stirling engine is connected with a main load and also with an auxiliary load via distributor. The alternating current generated by the dynamo is distributed to these loads. When the rotational speed of the Stirling engine varies, the distributor appropriately changes the ratio of the alternating current fed to the main load to the alternating current fed to the auxiliary load to let the dump electric power escape to the auxiliary load, thus maintaining the electric power supplied to the main load constant. The auxiliary load takes the form of a heater that heats up a tank in which water is stored.

During the operation of the Stirling engine, cooling water exchanges heat with a hot working medium in a cooler. Therefore, a large amount of hot water of a given temperature is obtained at all times. Furthermore, the hot water is used in various applications. On the other hand, the water heated by the heater, or the auxiliary load, is practically useless. That is, the dump power is merely discarded by heating water. This is by no means favorable from a point of view of energy saving.

SUMMARY OF THE INVENTION

It is an object of the invention to provide an apparatus which maintains the rotational speed of a Stirling engine constant and which makes effective use of the resulting dump power.

The above object is achieved by an apparatus for controlling the rotational speed of a Stirling engine, said apparatus comprising: a tank in which a working medium is stored; a first valve mechanism which is mounted between the working space in the Stirling engine and the tank and which, when the valve mechanism is open, permits the working medium to be forced out of the tank into the working space; a second valve mechanism which is mounted between the working space in the Stirling engine and the tank and which, when the second valve mechanism is open, permits the working medium to be expelled into the tank from the working space; a dynamo which is connected with the output shaft of the Stirling engine and which, when the engine operates, produces alternating current; an load that is electrically connected with the dynamo so that the alternating current may be applied to the load; an accessory which is attached to the Stirling engine and to which the alternating current is applied via a distributor; and a control unit which, when the electric power consumed by the load varies, appropriately controls the distributor, the first valve mechanism, and the second valve mechanism to adjust the amount of alternating current applied to the accessory and the pressure of the working medium in the working space.

In this apparatus, increases in the electric power caused by increases in the rotational speed of the Stirling engine can be consumed for the accessory such as a cooling fan or a battery for the starter. Hence, the dump power can be utilized effectively.

BRIEF DESCRIPTION OF THE DRAWING

The FIGURE is a block diagram of an apparatus for controlling the rotational speed of a Stirling engine, the apparatus being fabricated in accordance with the invention.

DETAILED DESCRIPTION OF THE INVENTION

Referring to the FIGURE, the output shaft of a Stirling engine 1 is connected to the shaft 8*a* of an AC dynamo 8 via a clutch mechanism 19. When the engine 1 is operated, the dynamo 8 is driven to produce alternating current of a given voltage. The produced current is applied to the load 7 such as an electrical appliance.

As is well known in the art, the working space in the Stirling engine 1 is sealed with helium or other working medium. The working medium is made to expand and contract repeatedly so that power taking the form of rotary movement may be taken from the output shaft of the engine. The working space is connected with a tank 14 holding the working medium, via a first valve mechanism 15 and a second valve mechanism 16. The first valve mechanism 15 consists of a solenoid valve 15*a* and a one-way valve 15*b* that permits the working medium to pass from the tank 14 toward the working space. The second valve mechanism 16 consists of a solenoid valve 16*a* and a one-way valve 16*b* that allows the working medium to flow from the working space toward the tank 14. The solenoid valves 15*a* and 16*a* are controlled by a control unit 12 in such a way that only one of them is opened at a time. The first valve mechanism 15 and the second valve mechanism 16 together form a valve mechanism that controls the circulation of the working medium between the working space and the tank 14.

In the Stirling engine 1, the hot working medium exchanges heat with cooling water, as well known in the art. The cooling water is supplied into a cooler (not shown) by a pump 2. After the heat exchange, heat is released from the cooling water by a cooling fan 4 in a radiator 3. However, the temperature of the cooling water is still considerably high, and the hot cooling water is used in various applications, as is known in the art. The alternating current generated by the dynamo 8 is applied to the cooling fan 4 via the distributor 5 or a power adjuster which is controlled by the control unit 12.

The alternating current produced by the dynamo 8 is supplied to a battery 20 via another distributor 6 or power adjuster that is also controlled by the control unit 12. The battery 10 powers a starter 9 for starting the engine 1, and is electrically charged during the operating of the engine 1.

A rotational speed sensor 11 is connected with the control unit 12 and disposed close to the shaft 8*a* of the dynamo 8. The rotational speed of the shaft 8*a* is detected by the sensor 11. Pulses or other electrical signal from the sensor 11 is delivered to the control unit 12. A current transformer 13 is connected with the dynamo 8 to detect changes in the current flowing through the load 7.

The structure built as described above operates in the manner described now. Let NR and NG be the rotational speed of the Stirling engine 1 and the rotational speed of the dynamo 8, respectively. If the electric power necessary for the load 7 or the electric power consumed by it varies, the torque TE applied to the engine 1 becomes different from the torque TG applied to the shaft of the dynamo 8. As a result, the rotational speed NG of the dynamo 8 will deviate from the rotational speed NR of the engine 1.

Changes in the electric power necessary for the load 7 or consumed by it are detected by the current transformer 13. The control unit 12 is informed of the detected changes. Then, the electric power W necessary for the load 7 after the changes is uniquely calculated by the control unit 12. The control unit 12 actuates either the first valve mechanism 15 or the second valve mechanism 16 according to the result of the calculation. Thus, the solenoid valve 15*a* or 16*a* is opened by the valve mechanism 15 or 16 to force the working medium out of the tank 14 into the working space or to expel the medium from the working space into the tank 14. Then, the pressure inside the working space increases or decreases. The rotational speed NR of the engine 1 is so adjusted as to correspond to the changes in the electric power required for the load 7. The torque TE applied to the Stirling engine 1 becomes substantially equal to the torque TG applied to the shaft of the dynamo 8.

Under this condition, the control unit 12 adequately adjusts the electric power WF supplied from the distributor 5 to the cooling fan 4 and the electric power WB supplied from the distributor 6 to the battery 10 so that the engine speed NR of the Stirling engine 1 may agree with the rotational speed NG of the dynamo 8 and that the torque TE applied to the engine 1 may coincide with the torque TG applied to the shaft of the dynamo 8.

As described thus far, the novel apparatus yields the following advantages.

(1) The electric power responds most quickly to changes in the load. Since changes in the electric power are detected, the output responsiveness of the Stirling engine is enhanced.

(2) Increases in the electric power which are caused by increases in the rotational speed of the Stirling engine can be consumed for the accessory such as the cooling fan or the battery for the starter.

What is claimed is:

1. An apparatus for controlling the rotational speed of a Stirling engine, comprising:

a tank in which a working medium is stored;

a first valve mechanism which is mounted between the working space in the Stirling engine and the tank and which, when the valve mechanism is open, permits the working medium to be forced out of the tank into the working space;

a second valve mechanism which is mounted between the working space in the Stirling engine and the tank and which, when the second valve mechanism is open, permits the working medium to be expelled into the tank from the working space;

a dynamo which is connected with the output shaft of the Stirling engine and which, when the engine operates, produces alternating current;

a load that is electrically connected with the dynamo so that the alternating current may be applied to the load;

an accessory which is attached to the Stirling engine and to which the alternating current is applied via a distributor; and a control unit which, when the electric power consumed by the load varies, appropriately controls the distributor, the first valve mechanism, and the second valve mechanism to adjust the amount of the alternating current applied to the accessory and the pressure of the working medium in the working space.

2. An apparatus for controlling the rotational speed of a Stirling engine as set forth in claim 1, wherein said accessory is a cooling fan.

3. An apparatus for controlling the rotational speed of a Stirling engine as set forth in claim 1, wherein said accessory is a battery for driving a starter.

4. An apparatus for controlling the rotational speed of a Stirling engine as set forth in claim 1, wherein said accessory comprises a cooling fan and a battery for driving a starter.

* * * * *